US009334877B2

(12) United States Patent
Nicholls et al.

(10) Patent No.: US 9,334,877 B2
(45) Date of Patent: May 10, 2016

(54) FAN ARRANGEMENT

(71) Applicant: Robert Bosch GmbH, Stuttgart (DE)

(72) Inventors: Stephen Nicholls, Strasbourg (FR); Sebastian Hansen, Sasbach (DE); Michael Burkart, Buehl (DE)

(73) Assignee: Robert Bosch GmbH, Stuttgart (DE)

( * ) Notice: Subject to any disclaimer, the term of this patent is extended or adjusted under 35 U.S.C. 154(b) by 765 days.

(21) Appl. No.: 13/706,384

(22) Filed: Dec. 6, 2012

(65) Prior Publication Data

US 2013/0142652 A1 Jun. 6, 2013

(30) Foreign Application Priority Data

Dec. 6, 2011 (DE) ..... 10 2011 087 831

(51) Int. Cl.
*F04D 29/58* (2006.01)
*F04D 29/52* (2006.01)
*F04D 29/54* (2006.01)

(52) U.S. Cl.
CPC ..... *F04D 29/52* (2013.01); *F04D 29/541* (2013.01); *F04D 29/58* (2013.01); *F04D 29/582* (2013.01)

(58) Field of Classification Search
CPC ... F04D 25/06; F04D 25/0646; F04D 25/064; F04D 25/0613; F04D 19/002; F04D 3/005; F04D 3/00; F04D 29/181; F04D 29/18; F04D 29/26; F04D 29/32; F04D 29/325; F04D 29/326; F04D 29/40; F04D 29/403; F04D 29/52; F04D 29/522; F04D 29/526; F04D 29/54; F04D 29/541; F04D 29/545; F04D 29/547; F04D 18/58; F04D 18/582
See application file for complete search history.

(56) References Cited

U.S. PATENT DOCUMENTS 3,677,660 A * 7/1972 Taniguchi ..... B63H 5/14 415/173.6
4,061,188 A * 12/1977 Beck ..... B60K 11/02 123/41.49
4,353,680 A * 10/1982 Hiraoka ..... F04D 29/646 415/201
4,396,351 A * 8/1983 Hayashi ..... F01P 5/06 123/41.49
4,566,852 A * 1/1986 Hauser ..... B01D 53/005 123/41.49
5,066,194 A * 11/1991 Amr ..... F04D 29/547 165/125
5,183,382 A * 2/1993 Carroll ..... F01P 5/06 123/41.49
5,248,224 A * 9/1993 Amr ..... F04D 29/547 415/220
5,443,363 A * 8/1995 Cho ..... F04D 29/545 415/208.2

(Continued)

FOREIGN PATENT DOCUMENTS

ES WO 2012160219 A1 * 11/2012 ..... E21F 1/08

*Primary Examiner* — Dwayne J White
*Assistant Examiner* — Joshua R Beebe
(74) *Attorney, Agent, or Firm* — Michael Best & Friedrich LLP

(57) ABSTRACT

A fan arrangement (1), in particular for cooling an engine system, comprising: an impeller (10) having one or more blades (4) which in operation convey a medium in the direction of an axis of rotation of the impeller (10) from an inlet side (E) to an outlet side (A); a housing shroud (6) having a base part (61) which extends in the direction of the axis of rotation and surrounds the impeller (10) completely or partially, wherein, on an end of the base part (61) oriented towards the outlet side (A) of the impeller (10), there is provided a discharge flow element (63) which extends radially outwards from the end of the base part (61).

8 Claims, 2 Drawing Sheets

(56) References Cited

U.S. PATENT DOCUMENTS 5,489,186 A * 2/1996 Yapp ..... F01D 5/141 415/208.3
5,881,685 A * 3/1999 Foss ..... F04D 29/545 123/41.49
6,116,856 A * 9/2000 Karadgy ..... B64C 11/00 29/888.025
6,123,051 A * 9/2000 Kubina ..... F01P 11/10 123/41.49
6,599,088 B2 * 7/2003 Stagg ..... F01D 5/143 415/173.6
7,478,993 B2 1/2009 Hong et al.
7,789,622 B2 * 9/2010 Acre ..... F04D 29/164 415/209.3
7,992,664 B2 8/2011 Kiener et al.
8,267,156 B2 * 9/2012 Wang ..... F04D 29/526 165/121
2002/0164247 A1 * 11/2002 Nadeau ..... F01D 5/225 415/173.3
2003/0026699 A1 * 2/2003 Stairs ..... F04D 29/582 416/192
2007/0224044 A1 * 9/2007 Hong ..... F04D 29/547 415/211.2
2010/0111667 A1 * 5/2010 Stagg ..... F04D 17/06 415/1

* cited by examiner

FAN ARRANGEMENT

BACKGROUND OF THE INVENTION

The present invention relates to a fan arrangement, in particular to a cooling fan for an engine system of a motor vehicle.

Axial ventilator fans have rotatable blades which are connected to form a fan wheel. In operation, a negative pressure is generated on an inlet side of the blades and an overpressure on an outlet side of the blades, leading to an air flow through the fan in a substantially parallel direction with respect to the axis of rotation of the fan wheel.

When used as a cooling fan for an engine system, the fan is arranged close to an engine block, whereby the air flow conveyed by the fan rebounds and is discharged towards the side, that is, transversely to the axis of rotation, of the intervening space formed by the engine block and the fan. Furthermore, because of the pressure difference between the inlet side and the outlet side, a reverse flow occurs close to the outer end of the blades, reducing the efficiency of the fan and leading to undesired pressure loss and noise generation.

In addition, turbulence can occur in the region of the lateral outflow from the intervening space between engine block and fan, leading to a pressure rise in the intervening space and impeding the discharge of the air. The efficiency of fan performance is thereby further reduced.

A fan arrangement comprising a fan wheel having at least one blade is known from U.S. Pat. No. 6,599,088 B2, the blade being located in an annular element which has a flared inner outflow surface with a shroud. The collar on the outflow side of the shroud has a radially outwardly directed edge surface which represents an extension of the flared inner outflow surface.

The above fan arrangement provides a special outflow geometry of the annular element. Furthermore, the edge surface of the shroud must be aligned with the geometry of the annular element. This increases cost and complexity in the manufacture of such a ventilator fan.

The document U.S. Pat. No. 7,478,993 B2 discloses a ventilator fan having fan wheel blades, the outer ends of which are connected to an annular element. The fan wheel moves inside a shroud extending beyond the fan wheel on the outlet side and having a coanda ring which extends radially inwards from the shroud on the outlet side of the fan wheel and has a flow-guiding contour in order to avoid as far as possible turbulence at the side of the intervening space between engine block and ventilator fan.

However, the provision of the coanda ring on the outlet side of the fan wheel increases the overall height of the ventilator fan, which is disadvantageous for use in the engine compartment of a motor vehicle. In addition, this solution is very susceptible with respect to component tolerances. Even small tolerance fluctuations lead to a deterioration of efficiency.

Furthermore, a device for controlling the flow through a fan arrangement in which blades are arranged adjustably in an annular element is known from the document U.S. Pat. No. 7,992,664.

SUMMARY OF THE INVENTION

It is the object of the present invention to make available a ventilator fan with which an improved discharge flow of the conveyed air, and thereby improved efficiency, can be achieved. In addition, the overall height, which determines the necessary distance between the fan wheel and a rebound surface, is not to be increased despite the improvement in efficiency.

According to a first aspect, there is provided a fan arrangement, in particular for cooling an engine system, comprising:

an impeller with one or more blades which in operation convey a medium in the direction of an axis of rotation of the impeller from an inlet side to an outlet side;

a housing shroud having a base part which extends in the direction of the axis of rotation and which wholly or partially surrounds the impeller, a discharge flow element being provided at an end of the base part oriented towards the outlet side of the impeller and extending radially outwards from said end of the base part.

One conception of the above fan arrangement consists in providing a flow guidance in such a way that turbulence in the lateral region at the side of the intermediate space between a rebound surface arranged on the outlet side and the fan arrangement is avoided as far as possible and, in addition, the overall height of the fan arrangement is not increased as compared to overall heights of comparable fan arrangements.

Furthermore, the base part may surround the impeller concentrically.

According to an embodiment, an end of the discharge flow element located opposite the base part may be bent in the direction of an end of the base part oriented towards the inlet side of the impeller in order to enlarge a channel formed with the discharge flow element.

Furthermore, the discharge flow element may be arranged on the base part fully or partially around the circumference thereof In particular, a reverse flow guide section extending radially inwards may be provided at an end of the base part oriented towards the inlet side of the impeller.

According to an embodiment, an annular element which connects outer ends of the blades to one another may be provided.

In addition, the annular element may have on the inlet side an end which projects outwardly and ends further outwards radially than the free end of the reverse flow guide section.

It may be provided that the discharge flow element ends with the outlet side of the impeller or is arranged between the inlet side and the outlet side with respect to the axial direction.

Alternatively, it may be provided that the discharge flow element is arranged on an end of the base part projecting beyond the outlet side of the impeller.

According to a further aspect, a system comprising the above fan arrangement and a cooling device is provided, the fan arrangement being arranged in such a way that in operation a medium is first aspirated through the cooling device and that, in an intermediate space between the fan arrangement and a rebound surface, conveyed medium is discharged transversely to the direction of the axis of rotation.

BRIEF DESCRIPTION OF THE DRAWINGS

Preferred embodiments of the present invention are explained in more detail below with reference to the appended drawings, in which.

DETAILED DESCRIPTION

Figure 1:
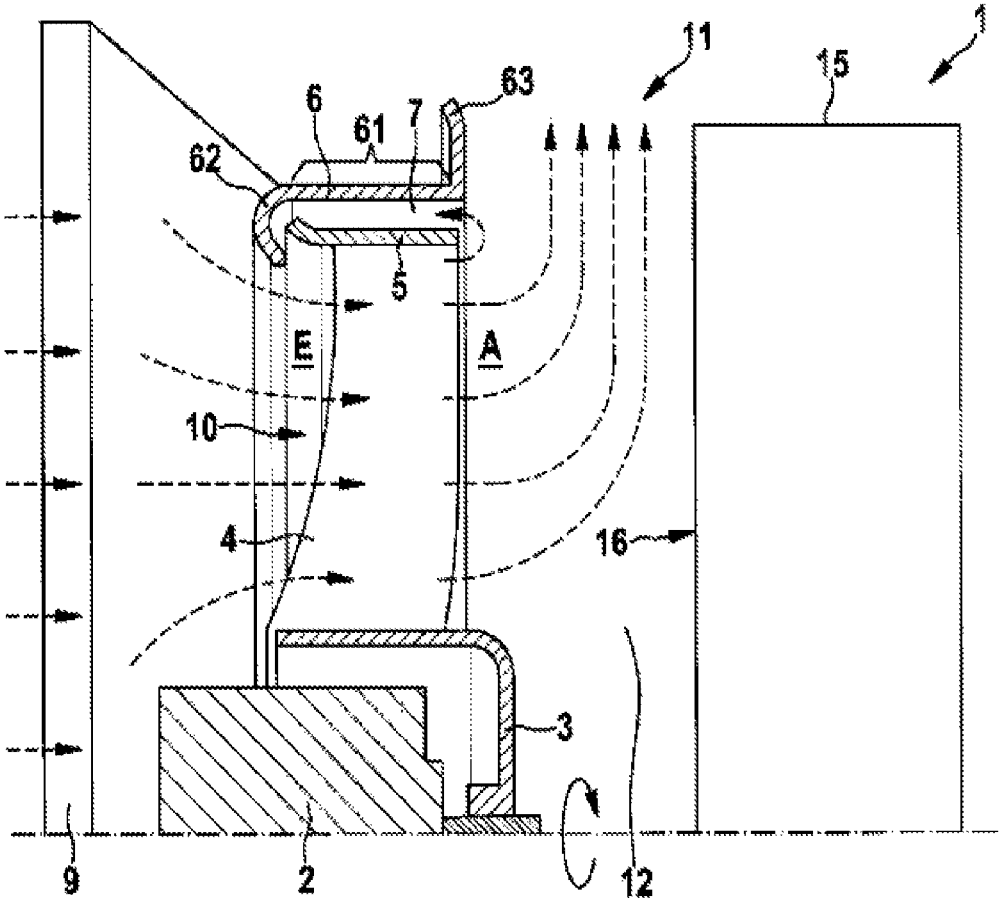
FIG. 1 is a schematic cross-sectional representation through a portion of a fan arrangement.

FIG. 1 shows a cross-sectional view of an embodiment of the fan arrangement 1. The fan arrangement 1 may be used in motor vehicles in order to cool a cooling device 9. The cooling device 9 may be arranged on the inlet side of the fan arrangement 1 and may be used to dissipate to the environment the waste heat produced during operation of an internal combustion engine or other drive unit.

An outlet side A of the fan arrangement 1 is arranged at a distance from a block 15, such as an internal combustion engine, so that an air stream conveyed through the fan arrangement 1 is directed substantially perpendicularly against a rebound surface 16 of the block 15.

A fan drive 2, which may be in the form of a DC motor, is coupled to a cylindrical or conical hub 3 in order to rotate same during operation of the fan arrangement 1. The cylindrical hub 3 carries one or more blades 4 which project in a radial direction from the hub 3, thus forming an impeller 10. The blades 4 have an oblique position and/or a surface curvature so that, upon rotation of the impeller 10, a pressure difference is built up across the impeller 10.

During operation, a negative pressure is produced on an inlet side E of the impeller 10, while an overpressure is produced on an outlet side A of the impeller 10, whereby an air flow through the impeller 10 is produced. The ends of the blades 4 may be connected to one another by an annular element 5, which contributes to improved stability of the impeller 10 by holding the radially outer ends of the blades 4 at a predetermined tangential distance from one another and preventing torsional oscillations.

The impeller 10 is surrounded wholly or partially by a shroud part 6 as a housing shroud which defines the flow channel between inlet side E and outlet side A of the impeller 10. During operation of the fan arrangement 1, a reverse flow channel 7 through which air can flow back from the outlet side A of the fan arrangement 1 to the inlet side E is formed between the annular element 5 and the shroud part 6. The reverse flow channel 7 is unavoidable, since a clearance between the annular element 5 and the shroud part 6 must be avoided as a result of component tolerances. The reverse flow channel 7 causes a reduction in the efficiency of the fan arrangement 1, since the air flowing through the reverse flow channel 7 cannot contribute to the cooling effect of the fan arrangement 1.

The shroud part 6 has in principle a cylindrical base part 61 which defines an inner region in which the impeller 10 is arranged. The shroud part 6 further has on the inlet side a reverse flow guide section 62 which produces a reduction in the reverse flow. For this purpose the shroud part 6 is bent inwards with a radius on the inlet side E of the fan arrangement 1, so that the shroud part 6, in conjunction with the cylindrical annular element 5, cannot form a rectilinear reverse flow channel 7 from the outlet side A to the inlet side E. The bending is effected in such a way that an end of the reverse flow guide 62 lies radially in line with or further inwards than the corresponding end of the annular element 5.

In addition, the annular element 5, which extends cylindrically around the blades 4, may be bent outwardly on the inlet side E of the fan arrangement 1, whereby a narrowing of the reverse flow channel 7 and guidance of the air flowing through the reverse flow channel 7 are achieved. These measures cause an increase in the flow resistance inside the reverse flow channel 7, whereby the quantity of air flowing through the reverse flow channel 7 is reduced and the associated reduction in efficiency is therefore diminished.

Opposite the reverse flow guide section 62 of the shroud part 6 a discharge flow element 63 extending radially outwards from the end of the base part 61 of the shroud part 6 is provided. The discharge flow element 63 may be arranged zonally in a plurality of sections on the cylindrical base part 61 of the shroud part 6, or around its full circumference. The discharge flow element 63 preferably extends perpendicularly to the axis of rotation of the impeller 10 and prevents the occurrence of turbulence in the lateral region 11 of the intervening space 12 between the internal combustion engine 15 and the fan arrangement 1. Instead of being arranged perpendicularly to the axis of rotation, the discharge flow element 63 may also be arranged obliquely to the axis of rotation, thus including an acute or obtuse angle with the base part 61. Especially in the case of an obtuse angle, the discharge flow element 63 extends into the lateral region 11 without, however, reducing the effective through-flow cross section.

In embodiments, the discharge flow element 63 may be formed integrally with the base part 61 or the housing shroud, or may be fitted to the base part 61 of the housing shroud 6 as a separate component in order to be able to retrofit an existing fan arrangement.

As a rule, turbulence leads to a pressure increase and a reduction in the aerodynamically effective through-flow cross section, since it impedes the air flow. By avoiding turbulence, an increase in the aerodynamically effective through-flow cross section is advantageously achieved by means of the discharge flow element 63, while retaining the overall depth in the lateral region 11, with a significant improvement in efficiency.

It may further be provided that a radially outer end of the discharge flow element 63 located opposite the end of the shroud part 6 on which it is arranged is formed obliquely, preferably being inclined in a direction towards the inlet side E of the fan arrangement 1.

Through the improved discharge into the environment of the air conveyed through the fan arrangement 1 from the intermediate region 12 via the lateral region 11, the reverse flow through the reverse flow channel 7 can be reduced, thereby improving efficiency.

Figure 2:
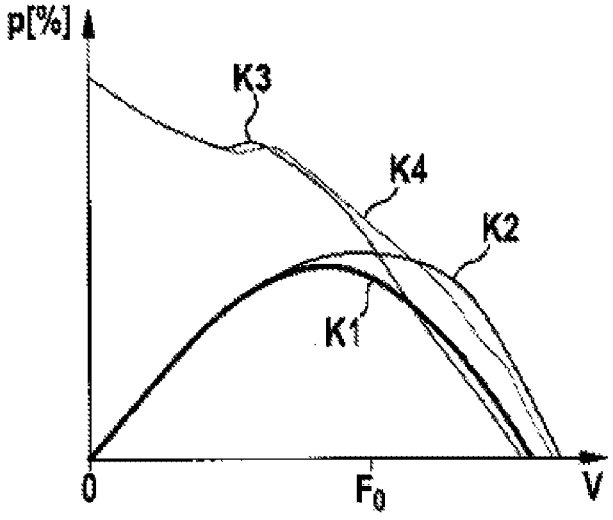
FIG. 2 is a graph representing the increase in efficiency and in power for a fan arrangement with discharge flow element and for a fan arrangement without discharge flow element.

FIG. 2 shows a graph in which the efficiencies and air throughputs as a function of the delivery rate F of the fan arrangement 1 are represented qualitatively for comparable fan arrangements with and without discharge flow element 63. The efficiencies are plotted in %. The curve K1 shows the efficiency for a fan arrangement 1 without discharge flow element 63 and the curve K2 shows the efficiency for a fan arrangement 1 with discharge flow element 63. The curve K3 shows the air throughput as pressure across the fan arrangement 1 for a fan arrangement 1 without discharge flow element 63 and the curve K4 shows the air throughput for a fan arrangement 1 with discharge flow element 63. It can be seen that above a certain delivery rate $F_0$ through the fan arrangement 1 a significant increase in efficiency and a significant increase in air throughput can be achieved.

Figure 3:
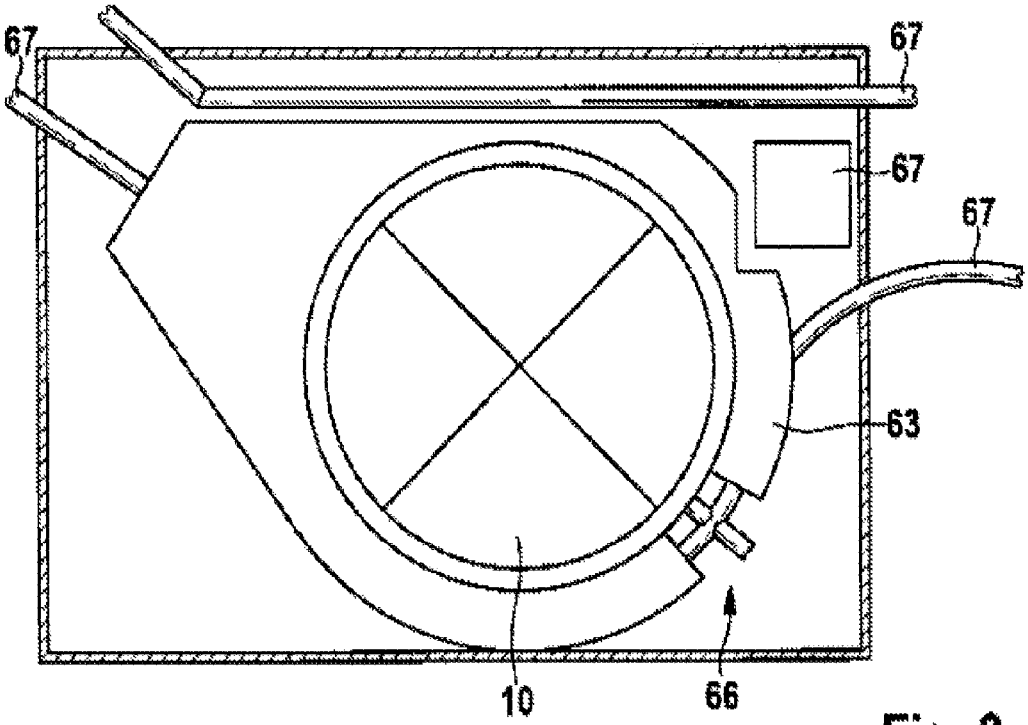
FIG. 3 is a plan view of a fan arrangement with a discharge flow element according to an embodiment.

FIG. 3 shows in a plan view of a fan arrangement an embodiment of the discharge flow element 63 which does not extend completely around the shroud part 6 but has openings 66. In addition, the discharge flow element 63 may be partially prolonged in a radial direction in order, for example, to cover fractured geometries produced by the positioning of hoses 67 and the like in the intermediate space 12 between the fan arrangement and the rebound surface 16.

The invention claimed is:

1. A fan arrangement (1) comprising:

an impeller (10) having one or more blades (4) which in operation convey a medium in the direction of an axis of rotation of the impeller (10) from an inlet side (E) to an outlet side (A) of the impeller; and a housing shroud (6) having a base part (61) which extends in the direction of the axis of rotation and surrounds the impeller (10) at least partially, wherein on an end of the base part (61) oriented towards the outlet side (A) of the impeller (10) there is provided a discharge flow element (63) which extends radially outwards from said end of the base part (61), and further extends in a direction oblique to the axis of rotation and towards the inlet side (E) of the impeller (10) to define a terminal end section, and wherein a reverse flow guide section (62) extending radially inwards is provided on an end of the base part (61) oriented towards the inlet side (E) of the impeller (10), wherein an annular element (5) which connects outer ends of the blades (4) to one another is provided with an end on the inlet side (E) which projects outwardly and ends radially further outwards than a free end of the reverse flow guide section (62) such that the end of the annular element (5) is at least partially contained within the reverse flow guide section (62) and the end of the annular element (5) is shaped to taper an axially extending reverse flow channel (7) formed between the annular element (5) and the base part (61) of the housing shroud (6).

2. The fan arrangement (1) according to claim 1, wherein the base part (61) surrounds the impeller (10) concentrically.

3. The fan arrangement (1) according to claim 1, wherein the discharge flow element (63) is arranged on the base part (61) over a full circumference of the base part.

4. The fan arrangement (1) according to claim 1, wherein the discharge flow element (63) ends with the outlet side (A) of the impeller (10).

5. The fan arrangement (1) according to claim 1, wherein the discharge flow element is arranged between the inlet side (E) and the outlet side (A) with respect to the axial direction.

6. The fan arrangement (1) according to claim 1, wherein the discharge flow element (63) is arranged on an end of the base part (61) which projects beyond the outlet side (A) of the impeller (10).

7. A system comprising:

arrangement (1) according to claim 1, and a cooling device (9), wherein the fan arrangement (1) is arranged in such a way that in operation a medium is first aspirated through the cooling device (9) and that medium conveyed into an intermediate space (12) between the fan arrangement (1) and a rebound surface (16) is discharged transversely to the direction of the axis of rotation.

8. The fan arrangement (1) according to claim 1, wherein the discharge flow element (63) is arranged on the base part (61) zonally.

* * * * *